US011261532B2

(12) United States Patent
Doughty

(10) Patent No.: US 11,261,532 B2
(45) Date of Patent: Mar. 1, 2022

(54) METHOD AND APPARATUS FOR ELECTROLYTIC REDUCTION OF A FEEDSTOCK COMPRISING OXYGEN AND A FIRST METAL

(71) Applicant: METALYSIS LIMITED, Rotherham (GB)

(72) Inventor: Greg Doughty, Rotherham (GB)

(73) Assignee: METALYSIS LIMITED

( * ) Notice: Subject to any disclaimer, the term of this patent is extended or adjusted under 35 U.S.C. 154(b) by 0 days.

(21) Appl. No.: 16/551,141

(22) Filed: Aug. 26, 2019

(65) Prior Publication Data

US 2020/0095696 A1 Mar. 26, 2020

Related U.S. Application Data

(63) Continuation of application No. 15/321,439, filed as application No. PCT/GB2015/051851 on Jun. 25, 2015, now abandoned.

(30) Foreign Application Priority Data

Jun. 26, 2014 (GB) ..... 1411433

(51) Int. Cl.

| | |
|---|---|
| ***C25C 3/00*** | (2006.01) |
| ***C25C 3/36*** | (2006.01) |
| ***C25C 5/04*** | (2006.01) |
| ***C25C 7/02*** | (2006.01) |
| ***C25C 3/26*** | (2006.01) |
| ***C22C 14/00*** | (2006.01) |

(52) U.S. Cl.

CPC ..... *C25C 3/36* (2013.01); *C22C 14/00* (2013.01); *C25C 3/26* (2013.01); *C25C 5/04* (2013.01); *C25C 7/025* (2013.01)

(58) Field of Classification Search

CPC .. C25C 3/00; C25C 3/28; C25C 7/005; C25C 3/26; C25C 7/025; C25C 1/00; C25C 7/00

See application file for complete search history.

(56) References Cited

U.S. PATENT DOCUMENTS

| | | | |
|---|---|---|---|
| 1,535,458 | A | 11/1923 | Frary |
| 3,188,282 | A | 6/1965 | Freedman |
| 5,754,392 | A | 5/1998 | Cava |
| 2005/0121333 | A1 | 6/2005 | Strezov |
| 2006/0065073 | A1 | 3/2006 | Shekhter et al. |
| 2012/0156492 | A1 | 6/2012 | Dudley et al. |
| 2014/0166502 | A1 | 6/2014 | Teng et al. |

FOREIGN PATENT DOCUMENTS

| | | |
|---|---|---|
| GB | 860335 | 2/1961 |
| WO | WO 2013/028126 | 2/2013 |
| WO | WO 2014/102223 | 7/2014 |

*Primary Examiner* — Zulmariam Mendez

(74) *Attorney, Agent, or Firm* — Saliwanchik, Lloyd & Eisenschenk

(57) ABSTRACT

A method of electrolytic reduction of a feedstock comprising oxygen and a first metal comprises the steps of, arranging the feedstock in contact with a cathode and a molten salt within an electrolysis cell, arranging an anode in contact with the molten salt within the electrolysis cell, the anode comprising a molten second metal and applying a potential between the anode and the cathode such that oxygen is removed from the feedstock to form a reduced feedstock. The oxygen removed from the feedstock reacts with the molten second metal to form an oxide comprising the second metal. The second metal is aluminium. The reduced feedstock may comprise a proportion of aluminium.

20 Claims, 1 Drawing Sheet

Figure 1:
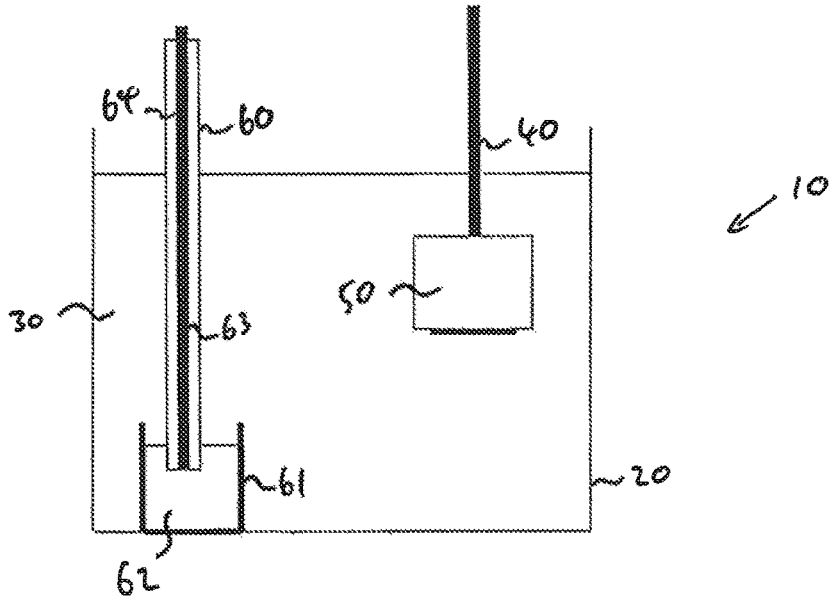

METHOD AND APPARATUS FOR ELECTROLYTIC REDUCTION OF A FEEDSTOCK COMPRISING OXYGEN AND A FIRST METAL

CROSS-REFERENCE TO RELATED APPLICATIONS

The present application is a continuation of U.S. application Ser. No. 15/321,439, filed Dec. 22, 2016, which is the National Stage of International Application Number PCT/GB2015/051851, filed Jun. 25, 2015, which is hereby incorporated by reference herein in its entirety, including any figures, tables, nucleic acid sequences, amino acid sequences, or drawings.

The invention relates to a method and apparatus for electrolytic reduction of a feedstock comprising an oxygen and a first metal, in particular to the production of metal by the reduction of a metal oxide.

BACKGROUND

The present invention concerns a method for the electrolytic reduction of a feedstock comprising oxygen and a first metal. As is known from the prior art, electrolytic processes may be used, for example, to reduce metal compounds or semi-metal compounds to metals, semi-metals, or partially-reduced compounds, or to reduce mixtures of metal compounds to form alloys. In order to avoid repetition, unless otherwise indicated the term metal will be used in this document to encompass all such products, such as metals, semi-metals, alloys, intermetallics. The skilled person will appreciate that the term metal may, where appropriate, also include partially reduced products.

In recent years, there has been great interest in the direct production of metal by direct reduction of a solid metal oxide feedstock. One such direct reduction process is the Cambridge FFC® electro-decomposition process, as described in WO 99/64638. In the FFC process, a solid compound, for example a metal oxide, is arranged in contact with a cathode in an electrolysis cell comprising a fused salt. A potential is applied between the cathode and an anode of the cell such that the compound is reduced. In the FFC process, the potential that produces the solid compound is lower than a deposition potential for a cation from the fused salt.

Other reduction processes for reducing feedstock in the form of a cathodically connected solid metal compound have been proposed, such as the Polar® process described in WO 03/076690 and the process described in WO 03/048399.

Typical implementations of direct reduction processes conventionally use carbon-based anode materials. During the reduction process the carbon-based anode materials are consumed and the anodic product is an oxide of carbon, for example gaseous carbon monoxide or carbon dioxide. The presence of carbon in the process leads to a number of issues that reduce the efficiency of the process and lead to contamination of the metal produced by reduction at the cathode. For many products it may be desirable to eliminate carbon from the system altogether.

Numerous attempts have been made to identify so-called inert anodes that are not consumed during electrolysis and evolve oxygen gas as an anodic product. Of conventional, readily-available materials, tin oxide has shown some limited success. A more exotic oxygen-evolving anode material based on calcium ruthenate has been proposed, but the material has limited mechanical strength, suffers from degradation during handling, and is expensive.

Platinum has been used as an anode in LiCl-based salts for the reduction of uranium oxide and other metal oxides, but the process conditions need to be very carefully controlled to avoid degradation of the anode and this too is expensive. Platinum anodes are not an economically viable solution for an industrial scale metal production process.

While an oxygen-evolving anode for use in the FFC process may be desirable, the actual implementation of a commercially viable material appears to be difficult to achieve. Furthermore, additional engineering difficulties may be created in the use of an oxygen-evolving anode, due to the highly corrosive nature of oxygen at the high temperatures involved in direct electrolytic reduction processes.

An alternative anode system is proposed in WO 02/083993 in which the anode in an electrolysis cell was formed from molten silver or molten copper. In the method disclosed in WO 02/083993 oxygen removed from a metal oxide at the cathode is transported through the electrolyte and dissolves in the metal anode. The dissolved oxygen is then continuously removed by locally reducing oxygen partial pressure over a portion of the metal anode. This alternative anode system has limited use. The removal of oxygen is dependent on the rate at which the oxygen can diffuse into the molten silver or copper anode material. Furthermore, the rate is also dependent on the continuous removal of oxygen by locally reducing partial pressure over a portion of the anode. Thus, this process does not appear to be a commercially viable method of producing metal.

SUMMARY OF THE INVENTION

The invention provides a method and apparatus for, electrolytic reduction of a feedstock comprising oxygen and a first metal, as defined in the appended independent claims. Preferred and/or advantageous features of the invention are set out in various dependent sub-claims.

In a first aspect a method of electrolytic reduction of a feedstock may be provided, the feedstock comprising oxygen and a first metal, for example being a compound comprising oxygen and a first metal. The method comprises the steps of arranging the feedstock in contact with a cathode and a molten salt within an electrolysis cell, arranging an anode in contact with the molten salt within the electrolysis cell, and applying a potential between the anode and the cathode such that oxygen is removed from the feedstock to form a reduced feedstock. The anode comprises a molten metal, which is preferably a different metal to the first metal comprised in the feedstock. The molten metal may be referred to as a second metal. The second metal is either aluminium or tin. While the second metal is not molten at room temperature it is molten at the temperature of electrolysis within the cell, when the potential is applied between the anode and the cathode. Oxygen removed from the feedstock is transported through the salt to the anode where it reacts with the molten metal of the anode to form an oxide comprising the molten anode metal and oxygen.

A key difference between the invention described in this aspect and the prior art disclosure of WO 02/083993 is that the molten anode metal of the present invention is consumed during the electrolysis process. In other words, the molten anode metal is a metal that readily oxidises on contact with an oxygen species in order to form an oxide comprising the second metal and oxygen.

Oxides formed at the anode during electrolysis may be in the form of particles which may sink into the molten metal exposing more molten metal for oxidation. The oxide formed at the anode may form particles that disperse into the molten salt and expose more molten metal for subsequent oxidation. The oxide formed at the anode may form as a liquid phase dissolved within the metal. The oxide can form rapidly at the surface of the molten anode, and can disperse away from the surface of the molten anode. Thus, formation of the oxide does not provide a significant kinetic inhibition on the oxidation reaction. By contrast the dissolution of oxygen into the molten metal anode of WO 02/083993 is dependent on solubility of oxygen in the molten metal anode, the diffusion of oxygen into the molten anode, and the transport of oxygen out of the anode under a reduced partial pressure.

Since the molten metal anode does not evolve oxygen gas, in contrast to inert anodes, the potential for oxidation of the cell materials of construction is removed. For example, when employing "standard" inert anodes, exotic materials would need to be selected for construction of the cell that are able to withstand oxygen at elevated temperatures.

The use of a carbon anode would result in CO and $CO_2$ evolution. Both CO and $CO_2$ are oxidising agents, but to a lesser extent than oxygen, and can attack the materials of construction. This may result in corrosion products entering the melt and consequently the product.

It is preferred that the second metal at the anode is at a temperature close to, and just above, its melting point during operation of the apparatus in order to reduce losses of the anode material by excessive vaporisation.

During operation of apparatus, a proportion of the second metal from the anode is preferably deposited at the cathode, where it may deposit on or interact with the reduced feedstock. Thus, the reduced feedstock may comprise both the first metal, i.e. the metal of the metal oxide in the feedstock, and additionally a proportion of the second metal.

The reduced feedstock may therefore comprise the first metal doped, or alloyed, with a proportion of the second metal. Doping, or alloying, of the first metal with a proportion of the second metal may introduce advantageous physical or electrical properties to the reduced feedstock. For example, a reduced feedstock comprising the first metal doped with a proportion of the second metal may exhibit a higher dielectric constant than a reduced feedstock comprising only the first metal. Other benefits of doping or alloying of the first metal with the second metal may include increased tensile strength, increased capacitance, increased electrical conductivity, reduced electrical conductivity, increased melting point, or reduced melting point. It may be advantageous to reduce feedstocks that contain a proportion of the second metal, for example aluminium, with the aim of forming metal alloys that comprise a proportion of the second metal. For example, if an operator wished to make a Ti-6Al-4V alloy, a feedstock may be prepared comprising a mixture of $TiO_2$, $V_2O_5$ and $Al_2O_3$. Aluminium contamination of the product would not be a problem in this circumstance. Indeed, the alumina content may be varied to reflect additional aluminium alloying originating from the anode.

The reduced feedstock may be a metallic alloy containing the second metal in various proportions. Preferably, the reduced feedstock is a metallic alloy comprising the first metal and between and between 0.01 percent by weight (wt %) and 5 wt % of the second metal. For example, the reduced feedstock may comprise between 0.01 wt % and 3.0 wt % of the second metal, or between 0.05 wt % and 2.0 wt %, or between 0.10 wt % and 1.50 wt %, or between 0.50 wt % and 1.0 wt % of the second metal. The present invention may be a convenient way of alloying a first metal with a low proportion of a second metal, the second metal being aluminium or tin.

Preferably, the proportion of the second metal comprised in the reduced feedstock may be controlled. Particularly preferably, controlling the length of time for which a potential is applied between the anode and the cathode determines the proportion of the second metal in the reduced feedstock.

The first metal is a different metal or alloy to the second metal. Preferably the first metal is, or is an alloy of, any metal selected from the list consisting of silicon, scandium, titanium, vanadium, chromium, manganese, iron, cobalt, nickel, germanium, yttrium, zirconium, niobium, molybdenum, uranium, actinides, hafnium, tantalum, tungsten, lanthanum, cerium, praseodymium, neodymium, samarium, actinium, thorium protactinium, uranium, neptunium and plutonium.

The skilled person will be able to select a feedstock comprising any first metal listed above and an anode comprising aluminium or tin.

The feedstock may be in the form of powder or particles or may be in the form of preformed shapes or granules formed from a powdered compound comprising oxygen and a first metal. In a preferred embodiment, the feedstock is in the form of powder or particles having an average particle size of less than 5 mm, for example less than 3 mm, or less than 2 mm.

The feedstock may preferably be an oxide of the first metal, for example titanium dioxide. The feedstock may contain oxides of more than one different metal. The feedstock may comprise complex oxides having multiple metallic species. The first metal may be an alloy. For example, the feedstock may be an oxide comprising an alloy of titanium and another metal. Alternatively, the feedstock may be a metallate compound, a metallate compound being a compound of the first metal, oxygen and at least one reactive metal, the reactive metal preferably being a group 1 or group 2 metal, for example a metal selected from the list consisting of calcium, lithium, sodium and potassium. The feedstock may be a metallate comprising titanium as the first metal, for example a calcium titanate such as $CaTiO_3$ or a lithium titanate such as $Li_2TiO_3$.

The second metal, i.e. the anode metal, may be commercially pure aluminium metal. Alternatively, the second metal may be an alloy of aluminium with one or more other elements, for example an alloy of eutectic composition. It may be desirable to have an alloy of eutectic composition in order to lower the melting point of the anode metal and thereby operate the process at a more favourable lower temperature.

The second metal, i.e. the anode metal, may be commercially pure tin metal. Alternatively, the second metal may be an alloy of tin with one or more other elements, for example an alloy of eutectic composition.

It may be desirable that the molten salt is at a temperature below 1000° C. when the potential is applied between the cathode and the anode. It may be particularly preferable to have the temperature of the molten salt during the process as low as possible in order to minimise the vapour pressure above the molten anode and thus the loss of the molten anode material. Thus, it may be preferable that the molten salt is maintained at a temperature of lower than 850° C., for example lower than 800° C. or 750° C. or 700° C., during electrolysis. So that the second metal comprising the anode is molten during the process, the molten salt must be maintained at a temperature greater than or equal to the melting point of the second metal. For example, when the anode metal is commercially pure aluminium metal, the molten salt should be maintained at a temperature greater than 660° C. When the anode metal is commercially pure tin metal, the molten salt should be maintained at a temperature greater than 232° C.

Any salt suitable for use in the electrolysis process may be used. Commonly used salts in the FFC process include calcium chloride containing salts. The molten salt may be a calcium containing salt, preferably a salt comprising calcium chloride. Due to the desirability of low temperature operation, it may be particularly desirable that the molten salt is a lithium-bearing salt, for example preferably a salt comprising lithium chloride. The salt may comprise lithium chloride and lithium oxide.

Fresh salts may contain residual carbonates and these carbonates may deposit carbon on the cathode, thereby increasing the carbon content of the product. Thus, it may be advantageous to pre-electrolyse the salt to remove residual carbonates prior to reduction of tantalate. Once used, salt is preferably re-used for multiple reductions. The use of a pre-electrolysed salt or a used salt may result in the salt having lower carbonate content and may help to produce tantalum with very low carbon content.

The second metal in the anode is consumed during the process due to the formation of an oxide between the second metal and oxygen. The method may advantageously comprise the further step of reducing the oxide formed at the anode, i.e. the oxide comprising the second metal and oxygen, in order to recover and re-use the second metal. The step of further reducing the oxide may take place after the electrolysis reaction has completed. For example, the oxide formed may be taken and reduced by carbothermic reduction or by standard FFC reduction. The recovered second metal may be returned to the anode.

The step of reducing the oxide comprising the second metal and oxygen may involve a system in which molten material at the anode is constantly pumped from the anode to a separate cell or chamber where it is reduced to recover the second metal, which is then transferred back to the anode. Such a system may allow a reduction cell to be operated for a long period of time, or a continuous period of time, as the anode material is constantly replenished as it is being consumed.

In preferred embodiments the feedstock may comprise a titanium oxide and the anode comprises molten aluminium. The reduced feedstock product may be titanium doped with aluminium. Titanium doped with a proportion of aluminium may possess different physical properties to pure titanium metal. For example, doping titanium with aluminium may improve its strength. The reduced feedstock may be a titanium alloy comprising between 0.01 percent by weight (wt %) and 5 wt % of aluminium. For example, the reduced feedstock may comprise between 0.01 wt % and 3.0 wt % aluminium, or between 0.05 wt % and 2.0 wt %, or between 0.10 wt % and 1.50 wt %, or between 0.50 wt % and 1.0 wt % aluminium.

In a preferred embodiment, the feedstock comprises a lithium titanate and the second metal is aluminium. In a particularly preferred embodiment, the feedstock comprises a calcium titanate, and the second metal is aluminium.

The use of an aluminium anode may provide a particular advantage over traditional carbon anodes when it comes to energy consumption. Due to the overpotential of aluminium being lower than that of carbon, a cell employing an aluminium anode may achieve reduction of its feedstock at a lower voltage than one using a carbon anode. For example, a cell using an aluminium anode may be run at a voltage of 1.5V to 2V, compared to 3V to 3.5V for similar reductions carried out using a carbon anode. This reduction in operating voltage may have significant beneficial cost implications.

In other preferred embodiments the feedstock may comprise a titanium oxide and the anode comprises molten tin. The reduced feedstock product may be titanium doped with tin. The reduced feedstock may be a titanium alloy comprising between 0.01 percent by weight (wt %) and 5 wt % of tin. For example, the reduced feedstock may comprise between 0.01 wt % and 3.0 wt % tin, or between 0.05 wt % and 2.0 wt %, or between 0.10 wt % and 1.50 wt %, or between 0.50 wt % and 1.0 wt % tin.

In a preferred embodiment, the feedstock comprises a lithium titanate and the second metal is tin. In a particularly preferred embodiment, the feedstock comprises a calcium titanate, and the second metal is tin.

The reaction of the oxygen removed from the feedstock with the anode material to form an oxide means that there is no evolution of oxygen within the cell. This may have significant engineering benefits, as the necessity to deal with high temperature oxygen off gases is negated.

As there is no carbon required for the electrolysis reaction to proceed, the product of the process, i.e. the reduced feedstock, has little to no carbon contamination. Although carbon contamination may not be an issue in the direct electrolytic reduction of some metals, for other applications and metals any level of carbon contamination is undesirable. The use of this method allows a direct reduction of an oxide material to metal at a commercially viable rate while eliminating carbon contamination. Furthermore, although the anode material is consumed during the electrolysis, it is possible to recover the oxide resulting from this consumption, reduce this oxide, and re-use the anode material.

Preferably, there is no carbon in contact with the molten salt within the electrolysis cell during the reduction process. Particularly preferably, the reduced feedstock produced by this process may comprise less than 100 ppm carbon, for example less than 50 ppm, or less than 25 ppm carbon.

The method may be used to reclaim metallic material such as metallic powder that has become contaminated with oxygen. For example, the feedstock may be metallic powder that has been heated in the presence of oxygen and thus contaminated with oxygen. Such powder may be formed, for example, as a waste product of a 3D printing process such as selective laser sintering or selective laser melting. Powder that is not incorporated into a product in such processes may be heated to a high temperature and cooled again, thereby picking up unwanted oxygen. The method may then be conveniently used to reclaim the contaminated powder.

In a second aspect, an apparatus for producing metal by electrolytic reduction of a feedstock comprising oxygen and a first metal comprises a cathode and an anode arranged in contact with a molten salt, the cathode being in contact with the feedstock and the anode comprising a molten metal. The molten metal is either aluminium or tin.

The apparatus may also comprise a power source connected to the cathode and the anode. This power source is capable of applying a potential between the cathode and the anode such that, in use, oxygen is removed from the feedstock.

SPECIFIC EMBODIMENTS OF THE INVENTION

Figure 2:
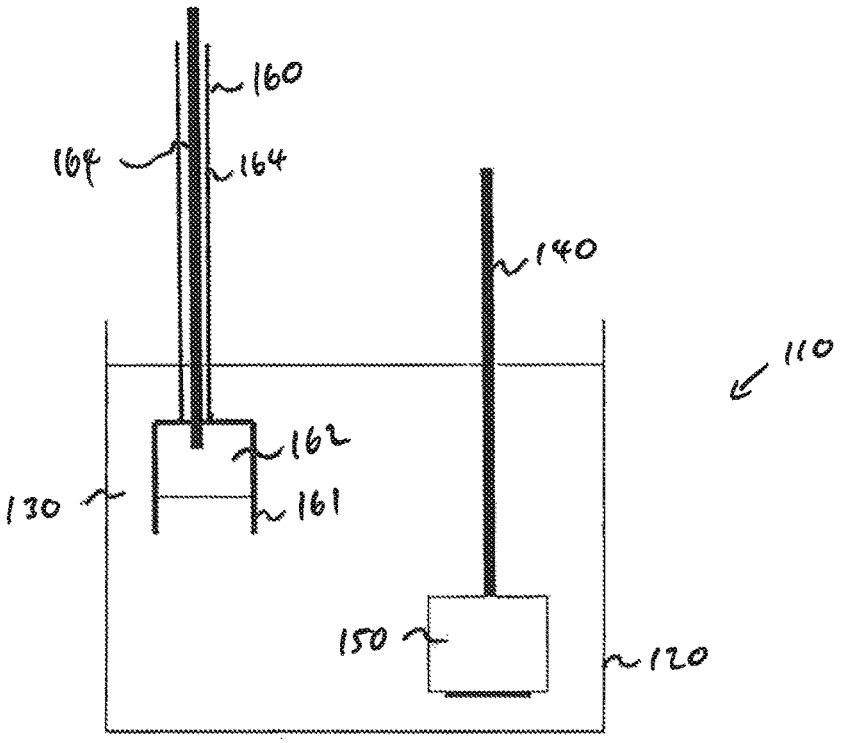

Specific embodiments of the invention will now be described with reference to the figures, in which FIG. 1 is schematic diagram illustrating an apparatus according to one or more aspects of the invention; and FIG. 2 is a schematic diagram of a second embodiment of an apparatus according to one or more aspects of the invention.

FIG. 1 illustrates an electrolysis apparatus 10 for electrolytic reduction of an oxygen bearing feedstock such as an oxide feedstock. The apparatus 10 comprises a crucible 20 containing a molten salt 30. A cathode 40 comprising a pellet of metal oxide 50 is arranged in the molten salt 30. An anode 60 is also arranged in the molten salt. The anode comprises a crucible 61 containing a molten metal 62, and an anode connecting rod 63 arranged in contact with the molten salt 62 at one end and coupled to a power supply at the other. The anode connecting rod 63 is sheathed with an insulating sheath 64 so that the connecting rod 63 does not contact the molten salt 30.

The crucible 20 may be made from any suitable insulating refractory material. It is an aim of the invention to avoid contamination with carbon, therefore the crucible is not made from a carbon material. A suitable crucible material may be alumina. The metal oxide 50 may be any suitable metal oxide. A number of metal oxides have been reduced using direct electrolytic processes such as the FFC process and are known in the prior art. The metal oxide 50 may be, for example, a pellet of titanium dioxide or tantalum pentoxide. The crucible 61 containing the molten metal 62 may be any suitable material, but again alumina may be a preferred material. The anode lead rod 63 may be shielded by any suitable insulating material 64, and alumina may be a suitable refractory material for this purpose.

The molten metal 62 is either aluminium or tin, both of which are liquid in the molten salt at the temperature of operation. The molten metal 62 must be capable of reacting with oxygen ions removed from the metal oxide to create an oxide of the molten metal species. The molten salt 30 may be any suitable molten salt used for electrolytic reduction. For example, the salt may be a chloride salt, for example, a calcium chloride salt comprising a portion of calcium oxide. Preferred embodiments of the invention may use a lithium based salt such as lithium chloride or lithium chloride comprising a proportion of lithium oxide. The anode 60 and cathode 40 are connected to a power supply to enable a potential to be applied between the cathode 40 and its associated metal oxide 50 on the one hand and the anode 60 and its associated molten metal 62 on the other.

The arrangement of the apparatus illustrated in FIG. 1 assumes that the molten metal 62 is more dense than the molten salt 30. This arrangement may be suitable, for example, where the salt is a lithium chloride salt and the molten metal is molten aluminium. In some circumstances, however, the molten metal may be less dense than the molten salt used for the reduction. In such a case an apparatus arrangement as illustrated in FIG. 2 may be appropriate.

FIG. 2 illustrates an alternative apparatus for producing metal by electrolytic reduction of an oxide feedstock. The apparatus 110 comprises a crucible 120 containing a molten salt 130, a cathode 140 comprises a pellet of metal oxide 150 and the cathode 140 and the pellet of metal oxide 150 are arranged in contact with the molten salt 130. An anode 160 is also arranged in contact with the molten salt 130 and comprises a metallic anode connecting rod 163 sheathed by an insulating material 164. One end of the anode 160 is coupled to a power supply and the other end of the anode is in contact with a molten salt 162 contained within a crucible 161. The crucible 161 is inverted so as to retain the molten metal 162 which is less dense than the molten salt 130. This arrangement may be appropriate, for example, where the molten metal is a liquid aluminium-magnesium alloy and the molten salt is calcium chloride.

The skilled person would be able to consult data charts to determine whether a particular molten metal is more or less dense than a particular molten salt in a combination used in an electrolysis reduction process. Thus, it is straightforward to determine whether or not an apparatus according to that illustrated in FIG. 1 or an apparatus according to that illustrated in FIG. 2 is most appropriate for conducting the reduction.

Although the illustrations of apparatus shown in FIGS. 1 and 2 show arrangements where a feedstock pellet is attached to a cathode, it is clear that other configurations are within the scope of the invention, for example, an oxide feedstock may be in the form of grains or powder and may be simply retained on the surface of a cathodic plate in an electrolysis cell.

The method of operating the apparatus will now be described in general terms with reference to FIG. 1. A cathode 40 comprising a metal oxide 50 and an anode 60 comprising a molten metal 62 are arranged in contact with a molten salt 30 within an electrolysis chamber 20 of an electrolysis cell 10. The oxide 50 comprises an oxide of a first metal. The molten metal is aluminium, which is capable of being oxidised. A potential is applied between the anode and the cathode such that oxygen is removed from the metal oxide 50. This oxygen is transported from the metal oxide 50 towards the anode where it reacts with the molten aluminium 62 forming aluminium oxide. The oxygen is therefore removed from the oxide 50 and retained within a second oxide of the molten anode metal.

The parameters for operating such an electrolysis cell such that oxygen is removed are known through such processes as the FFC process. Preferably the potential is such that oxygen is removed from the metal oxide 50 and transported to the molten metal 62 of the anode without any substantial breakdown of the molten salt 30. As a result of the process the metal oxide 50 is converted to metal and the molten metal 62 is converted, as least in part, to a metal oxide. The metal product of the reduction can then be removed from the electrolysis cell.

The inventors have carried out a number of specific experiments based on this general method, and these are described below. The metal product produced in the examples was analysed using a number of techniques. The following techniques were used.

Carbon analysis was performed using an Eltra CS800 analyser.

Oxygen analysis was performed using an Eltra ON900 analyser.

Surface area was measured using a Micromeritics Tristar surface area analyser.

Particle size was measured using a Malvern Hydro 2000MU particle size determinator.

Experiment 1

Aluminium used as the anode material was 99.5% Al shot supplied by Acros Organics. A feedstock pellet of mixed titanium oxide, niobium oxide, zirconium oxide and tantalum oxide was prepared by wet mixing powders of the four oxides, before drying, pressing into a pellet and sintering for 2 hours at 1000° C.

A 28 gram feedstock pellet of mixed oxides 50 was connected to a tantalum rod 40 and used as a cathode. 150 grams of aluminium 62 was contained in an alumina crucible 61 and connected to a power supply via a tantalum connecting rod 63 sheathed in a dense alumina tube 64. This construction was used as an anode 60. One kilogram of calcium chloride 30 was used as an electrolyte and contained within a large alumina crucible 20. The anode and pellet were arranged within the molten salt 30 and the temperature of the salt was raised to approximately 830° C.

The cell was operated in constant current mode. A constant current of 4 amps was applied between the anode and cathode for a period of 23.4 hours.

During this time the potential between the anode and the cathode remained at roughly 1.5 volts.

There were no gases evolved at the anode during electrolysis. This was due to the formation of aluminium oxide in the molten aluminium anode 62. A total charge of 336680 coulombs was passed during the electrolysis reaction.

After a period of 23.4 hours the cathode and cathode pellet were removed and the cathode pellet 50 had been discovered to have reduced to a metal alloy. Analysis showed that the metal alloy was contaminated with aluminium. Oxygen analysis of the reduced product provided an average value of 2289 ppm, a carbon content of 82 ppm and aluminium content of 4560 ppm.

Aluminium oxide is a solid at the temperatures of reduction. Aluminium oxide formed at the surface is likely to become entrapped within the molten aluminium in the alumina crucible and, therefore, free more molten aluminium for reaction with further oxygen ions.

Experiment 2

In order to demonstrate the drop in carbon content provided by the method of the present invention, Experiment 1 was repeated using a carbon anode instead of a molten aluminium anode.

A feedstock pellet of mixed titanium oxide, niobium oxide, zirconium oxide and tantalum oxide was prepared by wet mixing powders of the four oxides, before drying, pressing into a pellet and sintering for 2 hours at 1000° C.

A 28 gram feedstock pellet of mixed oxides was connected to a tantalum rod and used as a cathode. A carbon anode was connected to a power supply via a tantalum connecting rod sheathed in a dense alumina tube. One kilogram of calcium chloride was used as an electrolyte and contained within a large alumina crucible. The anode and pellet were arranged within the molten salt and the temperature of the salt was raised to approximately 830° C.

The cell was operated in constant current mode. A constant current of 4 amps was applied between the anode and cathode for a period of 18 hours. During this time the potential between the anode and the cathode remained at roughly 1.5 volts.

A total charge of 259039 coulombs was passed during the electrolysis reaction.

After a period of 18 hours the cathode and cathode pellet were removed and the cathode pellet 50 was discovered to have reduced to a metal alloy. Oxygen analysis of the reduced product provided an average oxygen value of 4039 ppm, and a carbon content of 3373 ppm. No aluminium was detected in the reduced metal alloy.

This showed that the use of a carbon anode resulted in the reduced feedstock having a carbon content of 3373 ppm—much higher than the 82 ppm carbon content produced in the same reduced feedstock when using an aluminium anode.

Experiment 3

A 45 gram pellet of tantalum pentoxide 50 was connected to a tantalum rod 40 and used as a cathode. 150 grams of aluminium 62 was contained in an alumina crucible 61 and connected to a power supply via a tantalum connecting rod 63 sheathed in a dense alumina tube 64. This construction was used as an anode 60. 1.6 kilogram of calcium chloride 30 was used as an electrolyte and contained within a large alumina crucible 20. The anode and pellet were arranged within the molten salt 30 and the temperature of the salt was raised to approximately 830° C.

The cell was operated in constant current mode. A constant current of 4 amps was applied between the anode and cathode for a period of 20 hours. During this time the potential between the anode and the cathode remained at roughly 1.5-2.5 volts.

There were no gases evolved at the anode during electrolysis. This was due to the formation of aluminium oxide in the molten aluminium anode 62. A total charge of 289391 coulombs was passed during the electrolysis reaction.

After reduction, the resulting metallic tantalum product was sieved and analysed. It was found that the courser material retained by a 500 μm sieve contained 5590 ppm O, 20 ppm C, and had a surface area of 3.4464 $m^2/g$. The fine material that passed through the sieve contained 5873 ppm O, 87 ppm C, and had a surface area of 1.3953 $m^2/g$. The product contained between 1.32 and 2.01 wt % aluminium.

Experiment 4.

In a further example, a 28 g pellet was manufactured from a sample of Iluka NR95 natural rutile powder. The powder was sieved to select a fraction consisting of particles having a particle size range of 150-212 microns. The pellet was reduced in calcium chloride using an molten aluminium anode. EDX analysis of the reduced product showed an aluminium content of 1.3 wt. %.

I claim:

1. A method of electrolytic reduction of a feedstock, the feedstock comprising oxygen and a first metal, the method comprising the steps of, arranging the feedstock in contact with a cathode and a molten salt within an electrolysis cell, arranging an anode in contact with the molten salt within the electrolysis cell, the anode comprising a molten second metal, the second metal being aluminium, and applying a potential between the anode and the cathode such that oxygen is removed from the feedstock to form a reduced feedstock, the oxygen removed from the feedstock reacting with the molten second metal to form an oxide comprising the second metal, in which a proportion of the second metal is deposited at the cathode when the potential is applied such that the reduced feedstock comprises the first metal and a proportion of the second metal.

2. The method according to claim 1, in which the reduced feedstock is a metallic alloy comprising the first metal and between 0.01 percent by weight (wt %) and 5 wt % of the second metal, for example, the reduced feedstock may comprise between 0.01 wt % and 3.0 wt % of the second metal, or between 0.05 wt % and 2.0 wt %, or between 0.10 wt % and 1.50 wt %, or between 0.50 wt % and 1.0 wt % of the second metal.

3. The method according to claim 1, in which the length of time for which a potential is applied between the anode and the cathode is controlled to determine the proportion of the second metal in the reduced feedstock.

4. The method according to claim 1, in which the feedstock is a compound comprising oxygen and the first metal, for example an oxide of the first metal.

5. The method according to claim 1, in which the feedstock contains oxides of more than one different metal, and/or in which the first metal is an alloy.

6. The method according to claim 1, in which the feedstock is a metallate compound, a metallate compound being a compound of the first metal, oxygen and at least one reactive metal, the reactive metal being a metal selected from the group consisting of calcium, lithium, sodium and potassium.

7. The method according to claim 1, in which the second metal is commercially pure aluminium metal, or in which the second metal is an aluminium alloy, for example an alloy of eutectic composition.

8. The method according to claim 1, in which the first metal is, or is an alloy of, any metal selected from the group consisting of silicon, scandium, titanium, vanadium, chromium, manganese, iron, cobalt, nickel, aluminium, germanium, yttrium, zirconium, niobium, molybdenum, hafnium, tantalum, tungsten, lanthanum, cerium, praseodymium, neodymium, samarium, actinium, thorium, protactinium, uranium, neptunium and plutonium.

9. The method according to claim 1, in which the molten salt is at a temperature at which the second metal is molten, but below 1000 degrees centigrade when the potential is applied between the cathode and the anode, or less than 850 degrees centigrade, or less than 800, or 750, or 700 degrees centigrade.

10. The method according to claim 1, in which the molten salt is a lithium bearing salt or a calcium bearing salt, or a salt comprising lithium chloride or calcium chloride.

11. The method according to claim 1, in which the feedstock comprises a titanium oxide and the anode comprises molten aluminium.

12. The method according to claim 1, in which the reduced feedstock is a titanium alloy comprising between 0.01 percent by weight (wt %) and 5 wt % of aluminium, for example, the reduced feedstock may comprise between 0.01 wt % and 3.0 wt % aluminium, or between 0.05 wt % and 2.0 wt %, or between 0.10 wt % and 1.50 wt %, or between 0.50 wt % and 1.0 wt % aluminium.

13. The method according to claim 1, in which the feedstock comprises a calcium titanate or a lithium titanate and the second metal is aluminium; or in which the feedstock is in the form of powder or particles having an average particle size of less than 3 mm; or in which the reduced feedstock is a metal powder.

14. The method according to claim 1, in which there is no carbon in contact with the molten salt within the electrolysis cell.

15. The method according to claim 1, in which the reduced feedstock comprises less than 100 ppm carbon, for example less than 50 ppm, or less than 25 ppm carbon.

16. An apparatus for producing metal by electrolytic reduction of a feedstock comprising oxygen and a first metal, the apparatus comprising a cathode and an anode arranged in contact with a molten salt in which the cathode is in contact with the feedstock and the anode comprises a molten metal, the molten metal being aluminium.

17. The apparatus according to claim 16, comprising a power source connected to the cathode and the anode.

18. The apparatus according to claim 17, in which there is no carbon in contact with the molten salt.

19. The method according to claim 1, in which substantially no gases are evolved at the anode during electrolysis.

20. A method of electrolytic reduction of a feedstock, the feedstock comprising oxygen and a first metal and the feedstock additionally comprising aluminium or aluminium oxide, the method comprising the steps of, arranging the feedstock in contact with a cathode and a molten salt within an electrolysis cell, arranging an anode in contact with the molten salt within the electrolysis cell, the anode comprising a molten second metal, the second metal being aluminium, and applying a potential between the anode and the cathode such that oxygen is removed from the feedstock to form a reduced feedstock, the oxygen removed from the feedstock reacting with the molten second metal to form an oxide comprising the second metal, in which a proportion of the second metal is deposited at the cathode when the potential is applied such that the reduced feedstock comprises the first metal and a proportion of the second metal.

* * * * *